United States Patent [19]

Van Loo

[11] 4,060,280

[45] Nov. 29, 1977

[54] FLAME-RESISTANT CUSHION

[75] Inventor: William Rudolph Van Loo, Grand Rapids, Mich.

[73] Assignee: American Seating Company, Grand Rapids, Mich.

[21] Appl. No.: 703,619

[22] Filed: July 8, 1976

[51] Int. Cl.[2] ..... A47C 5/12; A47C 7/18

[52] U.S. Cl. ..... 297/452; 5/354; 264/46.6; 297/DIG. 5; 428/310; 428/315; 428/921

[58] Field of Search ..... 297/DIG. 5, 452; 264/46.4, 46.6; 5/354, 355; 428/310, 315, 921

[56] References Cited

U.S. PATENT DOCUMENTS

| | | | |
|---|---|---|---|
| 2,789,629 | 4/1957 | Dewres | 5/354 |
| 3,027,967 | 4/1962 | Silver | 297/DIG. 5 |
| 3,204,016 | 8/1965 | Sanger et al. | 297/452 |
| 3,440,307 | 4/1969 | Printz | 297/452 |
| 3,519,308 | 7/1970 | Kasman et al. | 297/452 |
| 3,628,830 | 12/1971 | Mittans | 297/452 |
| 3,833,951 | 9/1974 | Hurwitz | 5/345 R |

FOREIGN PATENT DOCUMENTS

| | | | |
|---|---|---|---|
| 858,246 | 1/1961 | United Kingdom | 297/452 |
| 696,349 | 8/1953 | United Kingdom | 5/354 |

*Primary Examiner*—Paul R. Gilliam
*Assistant Examiner*—Alex Grosz
*Attorney, Agent, or Firm*—Emrich, Root, O'Keeffe & Lee

[57] ABSTRACT

A flame-resistant cushion includes a frame, an inner core of foamed polyurethane material carried by the frame, and an exterior layer of foamed neoprene bonded to and completely covering the entire surface area of the top, front, back and both sides of the core material. A metal pan is also secured to the seat frame to enclose the bottom of the cushion. In making the cushion, a latex water emulsion of neoprene is foamed and deposited in a thin layer on a carrier sheet. This composite lines a mold with the foam side engaging the mold; and unreacted polyurethane foam is poured into the mold. The adhesive properties of the polyurethane cause it to bond to the carrier sheet as it gels forming an integral cushion material with a covering of neoprene for greater fire resistance.

4 Claims, 4 Drawing Figures

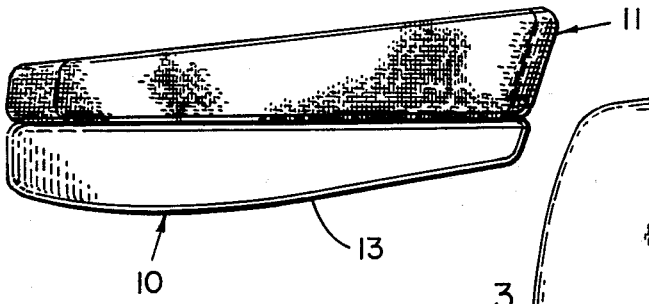
Fig. 1
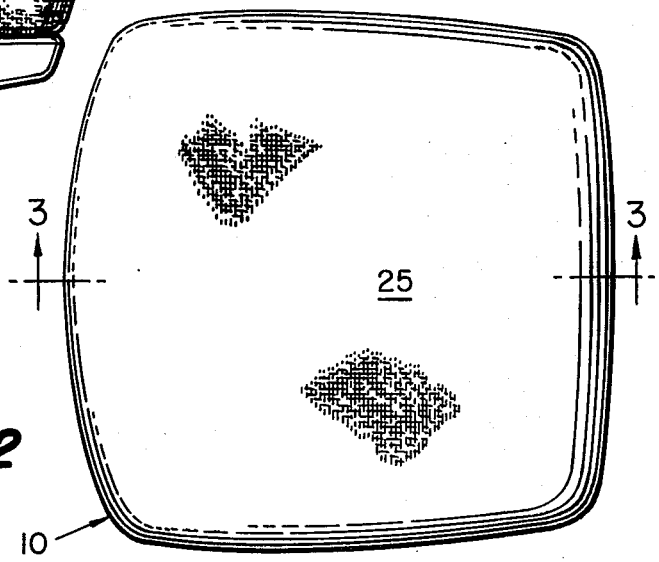
Fig. 2
Fig. 3
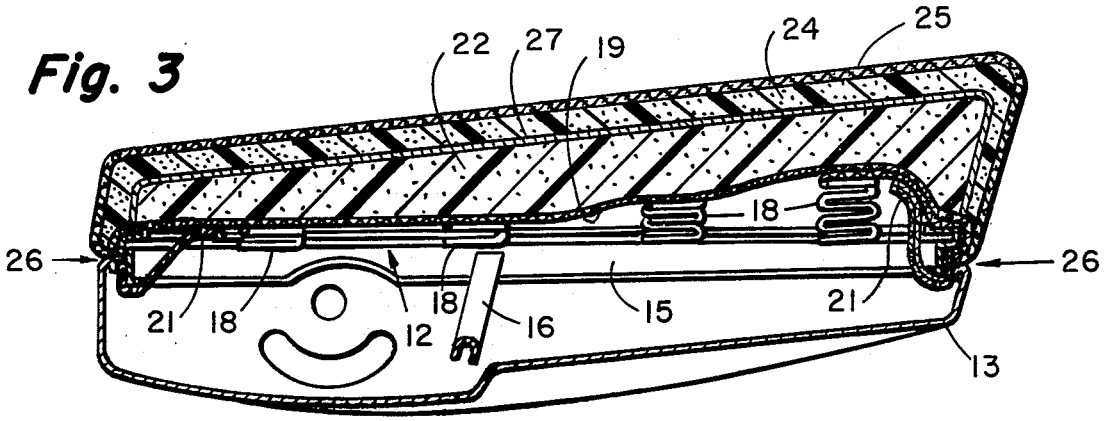
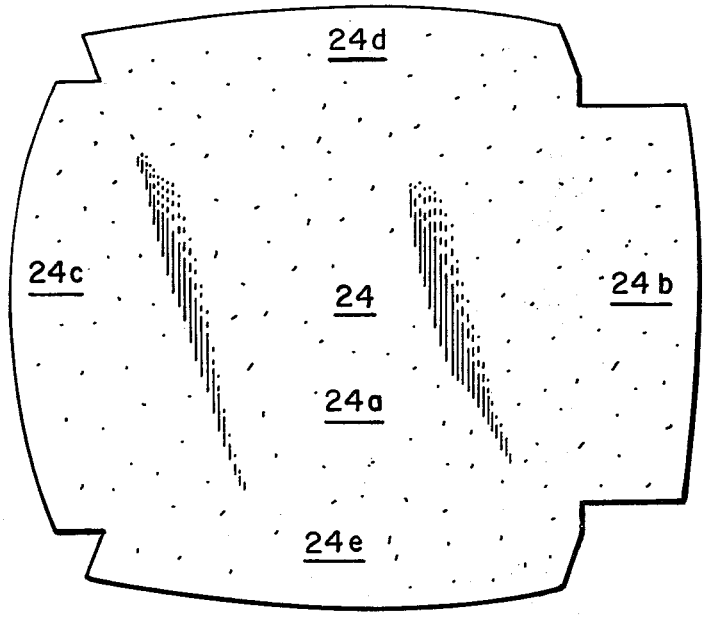
Fig. 4

FLAME-RESISTANT CUSHION

BACKGROUND AND SUMMARY

The present invention relates to a seat cushion; and more particularly, it relates to a seat cushion of the type used in public seating in auditoriums, theaters and the like wherein it is highly desirable that the cushion be resistant to flame or fire. In auditoriums, particularly where smoking is permitted, there is a danger that hot ashes or a match may be unwittingly dropped and land on a cushion, thereby presenting a fire hazard.

Some attempts have been made to produce fire-resistant cushions, such as that disclosed in U.S. Pat. No. 3,813,715, issued June 4, 1974. Such attempts generally rely on incorporating fire-resistant materials, such as asbestos, into the cushion, or they employ means for conducting heat away from localized areas. Either of the above-mentioned methods of producing flame-resistant cushions sacrifices either comfort or economy.

The present invention provides a flame-resistant cushion which includes a conventional frame assembly. An inner foam polyurethane material is carried by a "no-sag" spring structure which is an integral part of the frame. An exterior covering layer of foamed neoprene is integrally bonded to the entire surface area of the top, front, back and sides of the polyurethane core material by means of a carrier sheet so that the neoprene completely encompasses the polyurethane and provides a flame-resistant exterior for the five sides just mentioned. A metal pan is secured to the frame assembly to enclose the bottom of the cushion. and thereby provide a fully-enclosed flame-resistant cushion.

The cushion covering is made by forming a latex water emulsion of neoprene with suitable modifiers and frothing it with air. The frothed emulsion is foamed into a thin layer onto a carrier sheet (such as spun polyester) to form a composite. The composite, cut to shape, is used to line a mold with the foam side in (i.e., the foam contacts the mold surface). Unreacted polyurethane foam is poured into the mold on the carrier. The adhesive properties of the polyurethane cause it to bond with the carrier as it gels, thus forming an integral covering for the spring and frame.

I have discovered that by using a layer of neoprene which is at least three-sixteenths of an inch thick, and which fully surrounds the polyurethane core and is strongly bonded thereto throughout the entire interface, a cushion is provided which is flame resistant. Tests have shown that when the cushion is exposed to flame, the neoprene does not drip away to expose the more flammable polyurethane core. Rather, the neoprene chars and the ash forms a layer which acts as an insulator to retard the spread of flame. Obviously, if the polyurethane is permitted to get hot enough, it will flame; however, the first few minutes after ignition are often critical because it is during this time that a fire either builds up in intensity or dies out. It is during this period that the cushion of the present invention has shown itself to be quite resistant to flaming.

Further, a cushion made in accordance with the present invention has substantial savings in material costs while providing a soft, comfortable cushion.

Other features and advantages of the present invention will be apparent to persons skilled in the art from the following detailed description of the preferred embodiment accompanied by the attached drawing wherein identical reference numerals will refer to like elements in their various views.

THE DRAWING

FIG. 1 is a side view of a seat cushion constructed according to the present invention;

FIG. 2 is a plan view of the cushion of FIG. 1;

FIG. 3 is a vertical front-to-rear cross sectional view of the seat of FIG. 2 taken through the slight line 3—3 thereof; and FIG. 4 is a plan view of the composite cutout prior to insertion into a mold.

DETAILED DESCRIPTION

Referring then to the drawing, reference numeral 10 generally designates a seat cushion structure including a topper assembly 11, a frame assembly 12 (FIG. 3), and a lower steel seat pan 13.

The frame assembly 12 may be conventional, including a peripheral frame 15, and a cross bar 16 extending from side to side beneath the peripheral frame 15. A number of serpentine springs have their ends secured to the sides of the peripheral frame 15, also in conventional fashion. This structure is sometimes referred to as a "no-sag" spring assembly. Resting on the serpentine springs 18 is a flexible, shear-resistant support material 19 which may be cloth. At the forward and rear ends, the support material is wrapped around the peripheral frame 15 and stapled to itself as at 21.

Above the support material 19 is a body of foamed polyurethane material 22 comprising an inner core of highly flexible, resilient cushion material. The top, front, rear and both sides of the polyurethane core 22 are covered with a composite layer of foamed neoprene 24 and a carrier sheet 27. The composite is integrally bonded to the inner core 22 throughout all contacting surfaces. An outer fabric layer 25 is also provided for covering the entire topper assembly, and the edges of the outer covering 25 are crimped against the peripheral frame 15 by means of the upper edges of the lower seat pan 13, as at 26.

In making the topper assembly, a neoprene formulation including polychloroprene with suitable modifiers in a latex water emulsion is frothed with air and foamed into a thin layer onto the carrier sheet 27 (which may be a spun polyester, such as that marketed under the name Remey by E. I. DuPont DeNemours & Co. of Delaware) to form a composite. The neoprene forms a layer preferably not less than about three-sixteenths of an inch thick. The neoprene adheres to the carrier sheet throughout, and the carrier adds strength to the thin foam layer.

As seen in FIG. 4, the composite layer includes a top portion **24*a*, a front flap 24*b*, a rear flap 24*c*, and first and second side flaps 24*d* and 24*e*** respectively.

At each of the four corners, material is removed so that there will be no binding when the covering layer is placed into a suitably shaped mold. The composite is placed in the mold with the carrier out (i.e., the foam engages the mold surfaces). The flaps **24*b*–24*e*** will assume a generally vertical position when the composite is in the mold.

With the cut-out composite in the shape of FIG. 4 thus positioned within the mold cavity, the mixed ingredients for the polyurethane foam are poured into the cavity on top of the carrier, permitting it to foam. While it is foaming, the frame assembly 12, including the springs 18 and the cloth 19 are placed on the mold, in inverted position. The expanding, highly tacky polyurethane foam will adhere itself to the outer surface of the cloth 19, and it will form an extremely strong, continuous bond with the inner surface of the composite layer. This bond is so strong that the material will be destroyed before the bond is broken. The outer layer 25 and seat pan 13 may then be assembled according to well-known techniques.

When thus assembled, the composite with protective neoprene covers the top and four sides of the topper assembly 11, and the bottom pan 13 covers the remainder; and there is thus provided a highly flame-resistant cushion structure which is particularly suitable for use in auditorium or theater chairs, either as a seat cushion or, without obvious changes in form, as a back or arm rest cushion.

The test performed on the inventive product is a standard test referred to as the ASTM E-162-67 Radiant Panel Test in which the cushion is directly exposed to flame and a radiant heat source. In one test, a three-sixteenths-inch layer of neoprene covered polyurethane, with the overall thickness being one inch total. Results produced a flame spread index of 55 with no flaming drips formed. As mentioned, the neoprene forms a layer of charred ash which acts as an insulator to further retard the spread of flame. If the urethane gets hot enough, it will burn.

By comparison, a similar cushion having only a one-inch-thick layer of polyurethane, subjected to the same test, showed a flame spread index of 350–800 with flaming drips formed.

In addition to the desirable formation of a layer of charred ash which retards flame spread, as mentioned, the present invention has a substantial cost advantage over the use of neoprene alone. Further, in the method, by placing the composite of neoprene/fabric in the mold prior to foaming the polyurethane, a mold release is not required.

Having thus described in detail preferred embodiments of the invention, persons skilled in the art will be able to modify the steps which have been disclosed and to substitute equivalent structure for that illustrated while continuing to practice the principle of the invention; and it is, therefore, intended that all such modifications and substitutions be covered as they are embraced within the spirit and scope of the appended claims.

I claim:

1. A flame-resistant cushion comprising a metal frame assembly; an inner core of foamed urethane material carried by said frame; and exterior layer of foamed neoprene material covering the entire exterior surface of the top, front, back and sides of said inner core; means for uniting said core and said exterior layer together substantially throughout the adjacent surfaces thereof and a metal pan enclosing the bottom thereof and attached to said frame.

2. The structure of claim 1 wherein said exterior layer is formed from a continuous cut-out layer having a thickness of at least about three-sixteenths of an inch.

3. The structure of claim 1 further comprising an outer layer of fabric.

4. The structure of claim 1, wherein said uniting means comprises a carrier sheet.

* * * * *

Notice of Adverse Decision in Interference

In Interference No. 100,213, involving Patent No. 4,060,280, W. R. Van Loo, FLAME-RESISTANT CUSHION, final judgment adverse to the patentee was rendered Dec. 14, 1979, as to Claims 1, 3 and 4.

[*Official Gazette, April 29, 1980.*]